United States Patent [19]

Smith

[11] Patent Number: 4,570,052

[45] Date of Patent: Feb. 11, 1986

[54] ELECTRICAL THERMAL STORAGE HEAT SINK FOR SPACE HEATER

[76] Inventor: Marvin M. Smith, 1010 E. Parkway Dr., Muncie, Ind. 47304

[21] Appl. No.: 713,286

[22] Filed: Mar. 18, 1985

Related U.S. Application Data

[63] Continuation-in-part of Ser. No. 576,633, Feb. 6, 1984.

[51] Int. Cl.[4] ..... F24H 7/00; H05B 1/00

[52] U.S. Cl. ..... 219/378; 126/400

[58] Field of Search ..... 219/378; 126/400; 252/67, 71; 373/42, 120, 122

[56] References Cited

U.S. PATENT DOCUMENTS

| | | | |
|---|---|---|---|
| 3,053,705 | 9/1962 | Hewson | 252/71 |
| 3,400,249 | 9/1968 | Mekjean | 219/378 |
| 3,722,445 | 3/1973 | Karig | 219/378 |
| 3,737,620 | 6/1973 | Harvey | 219/378 |
| 4,220,196 | 9/1980 | Gawron | 126/400 |

FOREIGN PATENT DOCUMENTS

| | | | |
|---|---|---|---|
| 700755 | 11/1979 | U.S.S.R. | 126/400 |
| 965694 | 10/1982 | U.S.S.R. | 204/129.75 |

*Primary Examiner*—C. L. Albritton
*Assistant Examiner*—Teresa J. Walberg
*Attorney, Agent, or Firm*—Charles W. Rummler; John B. Lungmus

[57] ABSTRACT

A process for creating a thermal storage heat sink includes providing a mass of a salt or a salt mixture held in a hollow container having a wall made of electrically conductive material and having an insulated central electrode extending into the salt mass, installing a layer of an electrically conductive material of less density than the salt on top of and in contact with the salt mass to conduct electrical energy from the electrode to the container wall, and then heating the salt mass to a molten state by establishing an electric circuit from a power source through the electrode, the layer of conductive material and the container wall sufficient to melt the salt in contact with the conductive layer. This process is carried on by an electric thermal storage device including a hollow container made of a noncorrosive electrical conducting material, an electrode extending vertically into the container and insulated therefrom, a solid body of a salt or a salt mixture installed within the lower portion of the container and surrounding the portion of the electrode extending downwardly from above the level of the salt body, a layer of particulate electrical conductive material on top of and engaging the salt body and extending from the electrode to the container wall, the particulate material being of lighter weight than the salt which forms the salt body, and devices on the body and the electrode for electrically connecting both in an electrical circuit through the layer of particulate material.

7 Claims, 4 Drawing Figures

Temperature and energy history
for thermal Energy Storage project Run 1011

H - Heater
M - Middle Salt
T - Top Salt
L - Lower Salt
I - Inner Housing
O - Outer Housing
$Q_{in}$ - Electrical Energy Input
$Q_{out}$ - Air Heating

ELECTRICAL THERMAL STORAGE HEAT SINK FOR SPACE HEATER

BACKGROUND OF THE INVENTION

This application is a continuation in part of my copending application Ser. No. 576,633 filed Feb. 6, 1984.

Recognizing the need for obtaining a more productive and balanced load factor in the every day operation of electrical power generating utility plants, many organizations and state regulatory commissions have been proposing time-of-day, off-peak/on-peak, season tariff structures for electric energy use. It was the general belief that energy pricing could possibly compel Americans to alter their lifestyle and reshape their electric time-use patterns to off-peak periods thus providing benefits to the utility and lower costs to the consumer. It is now, however, contended that pricing alone cannot produce these benefits. It is believed that if this were to be achieved, there must be devices that lend themselves to off-peak operation which allow the customer benefits of service without the penalty of requiring a change in lifestyle. In the home, potential off-peak storage equipment applications are space heating, water heating and possibly cooling and it is agreed that Electric Thermal Storage (ETS) applications as now used in England and other foreign countries in space heaters, if properly installed, could be the answer.

Since space conditioning and water heating typically account for 60 to 70% of the home energy consumption, if storage equipment were available to the homeowner for this use on an economic basis, special time-of-day energy pricing could be justified and benefits would result to both the consumer and the utility.

With this objective, a study was made of a storage space heater, widely used and accepted in Europe with over 5,000,000 devices presently in use in England, France and Germany. In simplest terms, these devices use a brick-like refractory core material as a heat sink contained in a heavily insulated metal cabinet with the storage capacity sized to be totally energized in an eight hour period and to be capable of supplying all home heating needs during even the coldest sixteen hour on-peak period.

A thorough study of the English ETS concept indicated that such systems could be economically viable in the United States except for several reasons, the principal of which is the different local code requirements, along with inadequate available storage capacity to match the range of American weather conditions.

Central to the concept of the English off-peak ETS furnace is the storage unit which is comprised of three basic sections, the storage core, the air-flow dampers and the structural support plenum, and pertinent to my herein disclosed invention is the improvement of the storage core section that is now employed in the various English type ETS test units in operation in the United States.

SUMMARY OF THE INVENTION

It has been said that research breaks down a concept into many little problems, the solution of which creates a product. That has been highly illustrated in the development of the herein disclosed invention.

It became apparent from my study of the previous work in this field pertinent to my herein disclosed invention that efforts have been made concerning electric thermal storage heat sinks that carry their heating process through the fusion phase-change and which are made up of various materials for various purposes; some also suggest the use of both direct and indirect heating for injecting thermal energy into a sink for storage. I recognize these efforts; however, my research in this field, done in conjunction with an independent university engineering laboratory, and an internationally recognized research laboratory, indicates that in those previous researchers' broad statements, claims of accomplishment were pretty much based on desired results rather than the means and methods necessary to achieve those results. The means and methods pertinent to my statements of results, as disclosed herein, are from data acquired in actual research while reducing my concept to practice and are the bases of this invention.

As stated above, it is recognized that there are needs for electric storage space heaters by both customer and utility and also it is recognized that the core of any such device is its heat sink. This is the specific subject addressed in this invention and which involves new methods and the necessary means to make a practical electric thermal storage (ETS) device.

In designing a heat sink, consideration must be given to its purpose, source of heat, capacity, storage material, charging of energy, and operating temperatures, along, of course, with size, weight and cost. With this in mind, the immediate purpose of this invention is to not only provide a practical heat sink structure in which to store directly produced electrical thermal energy for use in a space heater but also a practical means of accomplishing the storage, this thermal energy to be created and stored during a lower electric rate off-peak period, usually defined as from 11 PM to 7 AM each weekday plus weekends and to be available for use during on-peak periods, which are 7 AM until 11 PM five days a week.

A most important part of this heat sink is the material in which thermal energy is to be stored. To this end, I have chosen and am disclosing herein operating results of test runs using an enclosed heat sink body including a mixture of off-eutectic material comprising 90% sodium carbonate ($Na_2CO_3$) and 10% Lithium carbonate ($Li_2CO_3$), the said body being carried through its several heating phases by heat created within itself by the flow of electric energy between an electrode at least partially embedded in the said mixture and the wall of an electrically conductive enclosure, the current flow being initiated by electrically conductive material carried on and in the upper surface of the mixture mass and extending from the electrode to the enclosure wall.

Test runs using these carbonate materials in this manner, as well as test runs of the same carbonates but with formulas having other percentages of the carbonate materials, also show excellent feasibility results and indicate means and methods that should be added to improve the overall performance of the heat sink as a source of heat for a space heater, and which additions are the bases of this invention. Since this is a new material for a heat sink use, it will be understood that my invention may require new materials and specifications as the invention is developed in practice, and it is to be expected that further research may one day develop different alloys or mixtures more favorable for use according to my invention. What is required is a compact mass of a normally solid or granular material suitable for cyclic melting and then solidifying without change of its constituency and capable of reaching about 1600° F. or more upon heating through its fusion stage.

DESCRIPTION OF THE DRAWINGS

Specific embodiments of this invention are shown in the accompanying drawings, in which.

DESCRIPTION OF A TYPICAL EMBODIMENT OF THE INVENTION

Figure 1:
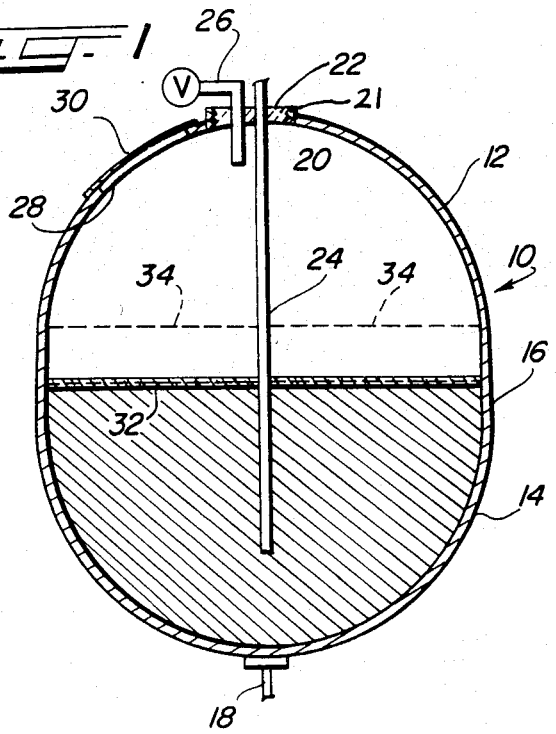
FIG. 1 is a diagrammatic illustration of the shape and construction of a preferred form of heat sink utilizing the invention and illustrating typical levels attained by its contents in the course of operation.

As herein disclosed, my method of practicing this invention is to contain the before mentioned mixture of carbonates in a container or vessel 10, referred to here as a fusion cell, made of corrosion and high temperature resisting material, such as high nickel stainless steel or other desired electric conducting material, which is preferably of a generally spherical shape although other shapes may be employed. With this vessel wall connected to an electric heating circuit as an electrode to deliver current to heat the salt mass inside the body of the container, another electrode suitably insulated from the container wall is installed vertically through the top of the container and into the contained salt mass, so as to provide a circuit for alternating current (i.e., 60 Hz) from electrode to electrode to energize and heat the body of salt contained in the cell directly by its own resistance through its various stages as its temperature increases. By this process of continued heating, the salt mass accumulates a specific heat gain along with the phase-change of fusion gains in the mass to make available for use 800 to 900 BTU's per pound of salt depending upon the carbonate formula. This is believed to be a considerable improvement over current practices.

Direct electric heating of the salt for use in this heat sink cell is preferable to indirect heating, although both were used in the tests of my system simply because of the hitherto unsolved problems that surfaced when starting and finishing the heating of the salt mass when using direct ohmic heating alone.

It must be understood that in the tests of my system the mass to be heated was only 7½ lbs. of the above disclosed carbonate salts, and this small mass was easily heated in the time allowed for this storage operation by a comparatively low temperature coil in conjunction with direct heating assistance. However, a heat sink in practical use in a home space heater must contain at least 300 lbs. of salt and thus the amount of energy necessary to transfer heat by indirect means, such as through a resistance coil, to heat this mass through its fusion phase in an allowed off-peak limited time would require a tremendous temperature differential between the coil and its salt recipient, be it from heating coils in the salt itself or from heating coils outside the cell walls. If this heat is delivered through the cell walls, the temperature differential between the coil and the salt for rapid transfer should be at least 800° F., so if the desired salt temperature in this cell is a reasonable 1600° F., the coil temperature to transfer its heat has to reach a temperature of at least 2400° F. This hot coil in contact with the cell wall can well approach the destructive temperature of any affordable wall material, thus critically affecting its life. Also at these temperatures, if the coil contacts the salt itself, it can easily reach its decomposition temperature and completely destroy its functioning as a heat sink. It should be understood that this device must be designed for many years of service-free operation and by using my hereinafter described direct ohmic method of heating the storage material in the sink, the maximum temperature obtained is in the salt itself and this temperature is limited automatically by the gradual disappearance of resistance to the electric flow between the electrodes as the salts approach and then pass through their molten state, thereby eliminating these problems. With this decrease of resistance, however, the temperature of the molten salt mass and its energy storage may be increased by raising the voltage of the current applied to the mass.

As above stated, direct ohmic heating of my before mentioned mixture of carbonates offers distinct advantages over indirect heating in that by this method the salt itself is both the resistance and the storage material, thus eliminating heat energy transfer onto or within the cell, which is a factor in completing the storage process more rapidly. When starting the heating process of the salt by this method, when the salt is in its solid state, provision must be made to assist the flow of electricity into and through the salt mass since in this state the mass is a nonconductor of electricity.

In order to establish this starting process toward total direct heating of the salt mass—when the salt is in its molten state in the fusion cell—I add onto the top of the salt mass an overall layer of particles or sections of a material which is an electric conductor and which is also of less density than the molten salt mass and which also has a higher melting point than the molten mass and strength sufficient to withstand pressures of the salt solidification, as well as to withstand corrosion at the high temperatures attained in this process. Under these specifications, this electrically conductive layer may comprise small, hollow, stainless steel balls and/or small diameter closed-end hollow, stainless steel tubing of short lengths. Since such materials are buoyant in the molten salt mass and steady when the salt is solid, they form a substantially integral layer on and into the top of the mass and become what could be called a permanent spark conducting "Pilot Layer" on and as a part of the salt mass.

To start the process of injecting electric energy into the solid salt mass, electric current is directed by a microprocessor through a constant current transformer which establishes and directs the necessary voltage of the injecting current into the Pilot Layer so as to conduct and spark its way through the material comprising the Pilot Layer from electrode to electrode. During this process, the sparks jumping between the added metal conductors complete the electric circuit in the Pilot Layer or flowing from one piece to another by direct contact create heat sufficient to approach the eutectic melting point of its adjacent and surrounding salt material which makes the adjacent salt itself at least semi-liquid and hence a conductor to establish electric current flow. The current flow through this newly melting salt creates its own high heat which is now thermally conducted to the adjacent salt so that this process, of combined electrical and thermal conduction, becomes progressive and continues downwardly from the pilot layer until it has reached a desired amount of thermal storage in the sink.

This charged Pilot Layer, with its intense heat, really acts in a manner similar to that of a high temperature resistance heating coil since it covers the whole salt mass, whether it is solid or molten, from the central electrode to the container wall and expands as such by its continuous electric and thermal conduction until all of the salt mass is molten, and does this without damage to the salt itself. If so desired, this pilot layer can be held in a constantly molten or semi-molten state by being energized in a controlled manner even while thermal energy is being withdrawn from the mass for external use. By this process, there is assurance that expansion pressures of the salts while absorbing heat will be started in the pilot layer at the top of the salt mass where such pressures will create no internal stresses. Also under these conditions, the pilot layer is always in an alert condition to perform its function of providing a closed circuit between the electrodes comprising the heat sink cell.

As herein shown and described, my preference, as to the shape of the salt container, or fusion cell, is a sphere-like vessel with its solid salt mass content reaching in the area of the top of the outward curve of the walls of the cell extending upwardly from the base, as shown in FIG. 1. My preference to this shape is based on the fact that this offers drift in the wall of the container to reduce direct pressures of the expansion of the salt mass while it absorbs thermal energy prior to becoming molten. By its shape, this cell also enables the salt mass, when cooling, to settle back into the base of the cell in solid contact with the electrodes when solidifying. These can be most important facts when using the sink as a source of thermal energy in daily operating cycles over a long period of time as required for a device such as a space heater where expansion and contracting pressures on the wall of the cell could be a factor in its life and continued performance. The cell itself need not be a true sphere but must be of such design as to contain the desired amount of the salt mix in its expanded liquid state in the lower portion of the cell and still leave space above the salt mass sufficient to contain the gas to be sealed in the cell to one atmosphere of pressure when the salt is heated to its molten state.

In the form shown in FIG. 1, my preferred fusion cell 10 comprises upper and lower semi-spherical sections 12 and 14, respectively, made of high nickel stainless steel, for example, of about 16 gage, separated by a central cylindrical section 16 of the same material, all sections being formed in such a manner as to be easily welded together to form a substantially spherical and hollow receptacle. At the bottom center of the receptacle an integral electrical connection 18 is provided and at the top center of the receptacle an opening 20 is formed by a collar 21 welded to the receptacle for sealed reception of a ceramic holder 22 in and through which a vertical electrode 24 is installed in sealed relation with the holder 22 and the opening 20. The ceramic holder 22 includes a valved tube 26 leading to the interior of the receptacle 10.

In the assembly shown, the electrode 24 extends into the receptacle 10 for about four-fifths of its total height, well into the lower section 14 and the outer end of the electrode is adapted for connection to an electrical power source. Also, an opening 28 is provided in the upper portion 12 of the fusion cell body 10 for the introduction of the salt mass content of the cell and the electrically conductive material which is to form the pilot layer. Following the introduction of the desired molten salt mass and the material comprising the pilot layer, the opening 28 is welded shut, gas-tight, by means of a closure plate 30.

The fusion cell 10 shown in FIG. 1 may, for example, have a total height of about 28 inches, of which each semi-spherical section is 12 inches deep and the middle section 16 is about 4 inches wide. A receptacle of this size might have a salt content of 600 pounds of the before mentioned off-eutectic mixture which in the solid state, including the pilot layer indicated at 32, would fill the lower semi-spherical portion 14 and a portion of the middle area 16.

To load the fusion cell 10, the desired amount of the salt mixture is preferably introduced into the cell in a molten state and would reach a level about as indicated by the broken line 34. Upon cooling to a solid state, this amount of the salt material would shrink to about the middle of section 16 in the cell. Preferably the cell is sealed gas-tight as soon as the desired amount of molten salt mixture has been installed. Thus upon the mass cooling to its solidified state, and the salt shrinks back to its normal solid state volume, from its about 128 percent liquid state volume, the process will create a partial vacuum or a minus pressure within the sealed cell.

This procedure establishes a very beneficial condition for the cell wall in that as the inside pressure decreases to a partial vacuum as the salt cools and solidifies the external pressure on the wall increases, but these external pressures occur when the walls are comparatively cold and are at their maximum strength thus creating no structural problem.

In this way, whenever heat is again applied to the salt mass in the cell and the minus pressure becomes positive as the mass becomes molten, the internal pressure in the cell will be at about one atmosphere just as it was when the cell was originally sealed. Thus, at this time, the inside and outside pressures are equalized and exert no stress on the now hot walls of the cell thereby enabling the use of thinner and less expensive materials for the containing wall of the cell structure.

Because working conditions around and on a 1600° F. fusion cell can be unpleasant, the same result of maintaining a one atmosphere internal pressure in the cell when the salt therein is molten may be had by introducing the molten salt material as before mentioned and letting it cool to the solid state before sealing the cell. Then after sealing the cell by welding plate 30 over opening 28, the air within the cell can be pumped out through the valve 26 to the point where the interior of the cell will be at a pressure sufficiently less than one atmosphere so that when the salt mass again becomes molten the internal pressure of the cell will be about the same as the ambient pressure surrounding the cell.

In the testing of my heat sink system, it was observed that there was a complete elimination of sizable voids in the carbonate mass when cooled from its molten state due to the fact that each carbonate, because of its physical properties, solidified at its own individual temperature and time and internal mass stresses just did not occur.

Figure 4:
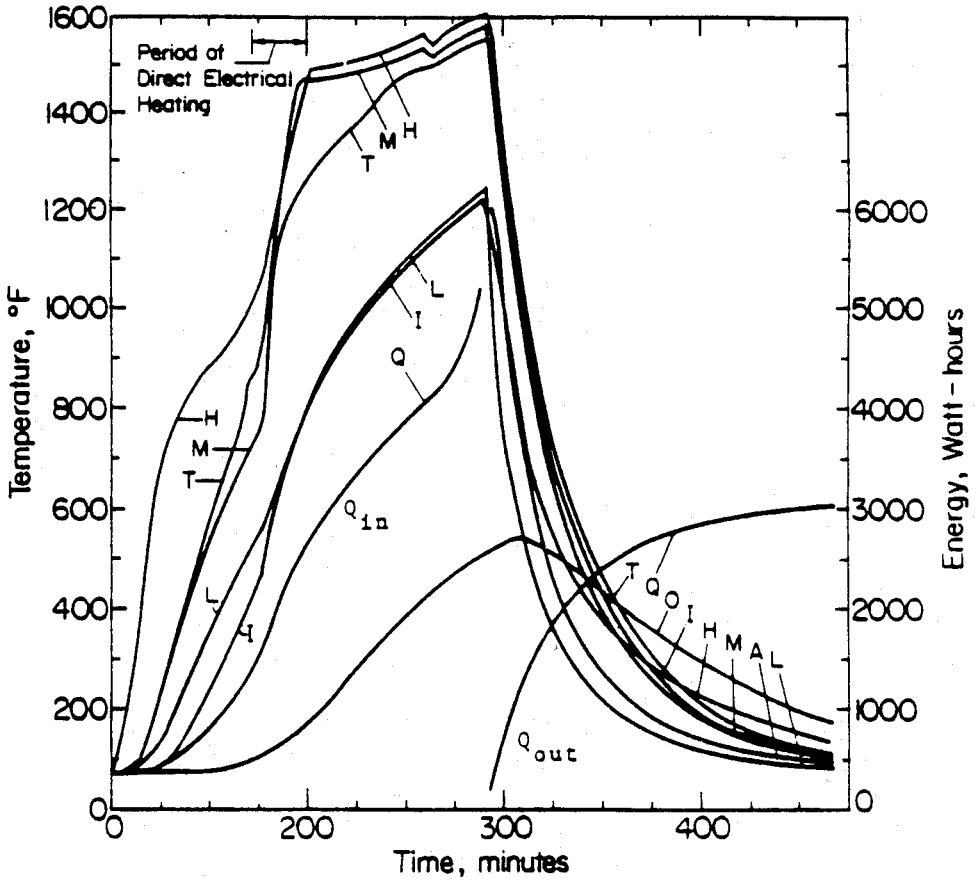
FIG. 4 is a chart comprising a set of curves illustrating the temperature and energy history for thermal energy storage developed in the course of a typical run of the system illustrated by FIG. 3, carried out over a period of several months in the testing of my invention.

It was also discovered that when using direct heating exclusively, there was a problem of continuing the increase of the temperature of the mass when it has reached its molten state, as is evident in the curves of FIG. 4 which depict the conditions occurring in my Test No. 1011. This is because, in the fully molten state, there is little resistance to the electric flow through the salt mass and hence the salt material can contribute little to the energy storage in the sink unless assisted. I have found that the energy storage in the sink can be assisted by increasing the voltage of the electricity entering the mass from a constant current transformer; first in sensing the need and then delivering this needed voltage so that even at the low resistance of the now molten mass, thermal energy can be continued to be delivered into the sink.

Another method of doing this is to add to the carbonate mixture a catalyst that will increase the absorption requirements to complete the heat of fusion change of the existing salts and without affecting their other physical properties. Still another means is to add to the mixture a small amount of another compatible material such as aluminum silicate, that has a slightly higher temperature melting point than the carbonate's eutectic melting point and hence a delayed process of its fusion change to thus continue the resistance to the electric flow at a higher ohmic level so as to not only continue the heating process but also to add to the thermal energy accumulated in the heat sink.

There is also evidence that in the melting phase, my off-eutectic mixture of carbonates, upon becoming liquid, actually becomes a solution (Na Li $CO_3$) but in the reverse phase change, they solidify back to their original and separate carbonates. Also I have discovered that by starting the heating process of the mass in the manner above disclosed, i.e., progressively from the top down, by direct heat, the intensive internal stresses within the salt mass and any voids that might be created are eliminated which assures for better electric and thermal conductivity through the mass when storing heat and also when recovering that energy for external use.

Figure 2:
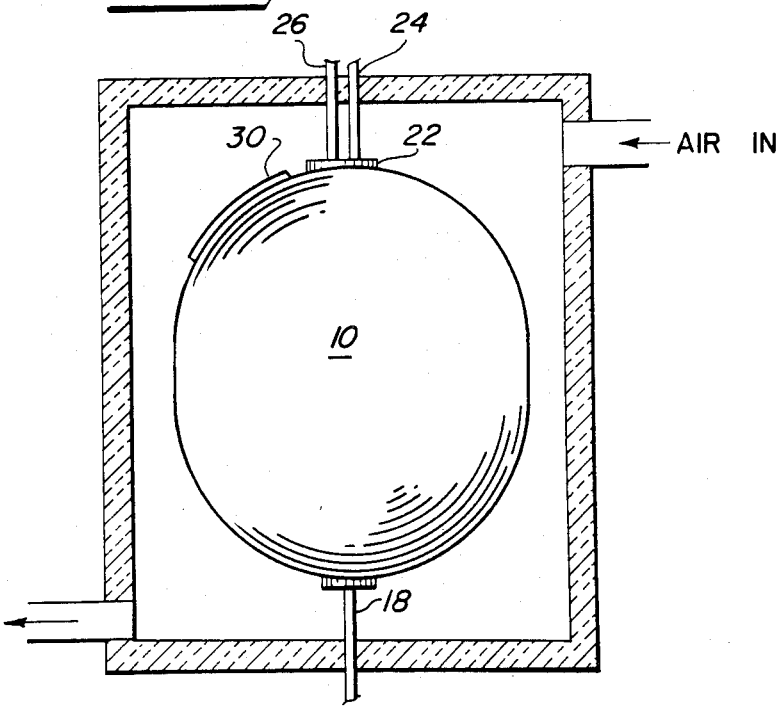
FIG. 2 is a more-or-less diagrammatic illustration of a housing for a heat sink like that of FIG. 1 and illustrating a means for recovering heat at a high temperature by means of a suitable carrier for use in other devices requiring a supply of thermal energy.
Figure 3:
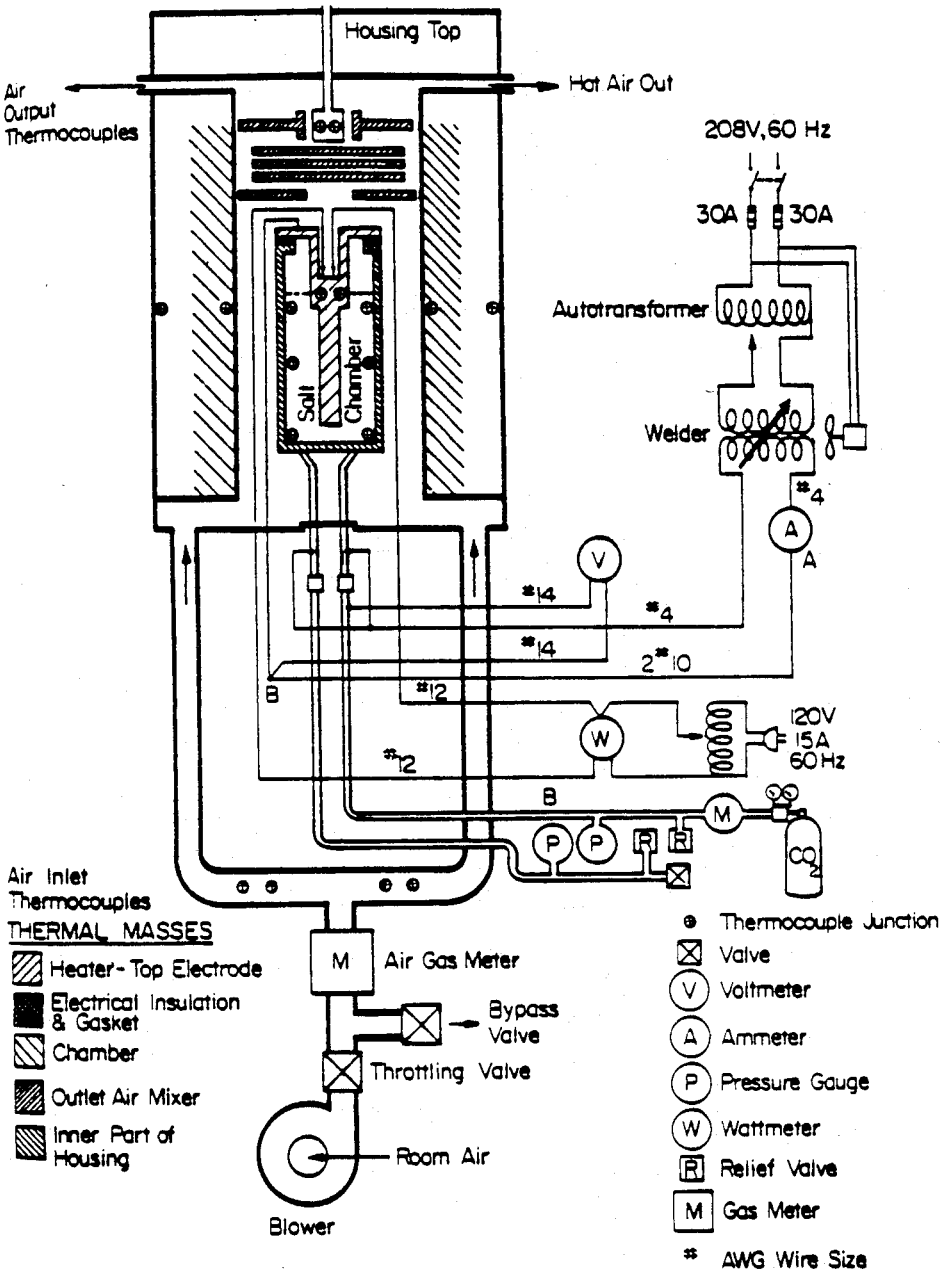
FIG. 3 is a diagrammatic illustration of the apparatus and control system used for testing the feasibility of my invention.

When loading the cell with the desired amount of the salt composition, the molten mixture is introduced into the cell under pressure and in a measured amount in volume so that upon solidification, it will reach a proper point of level in the cell. When this is done and the before mentioned pilot layer material is added to the salt mass the cell is now ready to be assembled electrically and mounted in a holding cradle, not shown, that is electrically insulated from the fusion cell, and then to be installed in the cell container, either singly or in multiple. FIG. 2 illustrates a container for a single cell, together with inlet and outlet connections for the passage of air, or other gaseous means, to pick up heat from the cell for delivery to other means for utilizing the heat delivered from the cell.

The test run illustrated by FIG. 4 of the drawings had no period of preheating. The cartridge coil heater was gradually brought up to a proper level of 670 watts and direct heating was introduced, as in previous runs, for about one hour starting at time—140 minutes. FIG. 4 shows that the salt temperatures increased greatly from an average temperature at 745° F. to 1227° F. during this period. At time—205 minutes, the direct heating was turned off and the remainder of the heating was accomplished with a cartridge heater powered at 670 watts. At the time level of about 290 minutes, the middle (M), top (T) and lower (L) salt temperatures were 1589° F., 1559° F., and 1248° F., respectively, giving an average salt temperature of about 1465° F. At this time, the cartridge heater was turned off and the housing was raised about one-half inch and the air blower was turned on so that air flowed through the apparatus at a volumetric flow rate of about 8 cubic feet per minute. During the cooling period, the salt mixture in the test apparatus provided about 681 BTUs per pound of salt as the salt cooled from an average temperature of about 1459° F. to 100° F. The reason that there is no visible evidence of latent heat of fusion in the curves of FIG. 4 is that the salt is not at a uniform temperature during phase change from a solid to a liquid.

At the present time, there is increased thinking in building circles toward placing the domestic space heating plant outside of the home instead of inside, due to the problems of installation and cost of building a suitable area in the home to contain the space heater. The public has accepted the placement of the air conditioner condenser outside and the thinking is now drifting toward similar locations for home heating plants. The herein disclosed high temperature heat sink assembly lends itself to this idea in that it has insulation and methods to contain its heat regardless of its location.

Although but one specific embodiment of this invention has been herein shown and described in detail, it will be understood that numerous details of the system shown and operation described may be altered or omitted without departing from the spirit of the invention as defined by the following claims.

I claim:

1. The method of loading a normally solid electrically nonconductive material of a kind that becomes conductive when in a molten state and is suitable for cyclic melting and solidification into an electro thermal storage vessel which comprises the steps of introducing a predetermined quantity of said nonconductive material into said vessel, introducing a predetermined quantity of an electrically conductive particulate material onto a surface of said nonconductive material, and then sealing said vessel gas-tight to enclose the nonconductive and conductive material for cyclic electro thermal melting and then solidification of the nonconductive material.

2. The method of loading a normally solid electrically nonconductive material of a kind that becomes conductive when in a molten state and is suitable for cyclic melting and solidification into an electro thermal storage vessel which comprises the steps of introducing a predetermined quantity of said nonconductive material into said vessel, introducing a predetermined quantity of an electrically conductive particulate material onto a surface of said nonconductive material, sealing said vessel gas-tight to enclose the nonconductive and conductive materials for cyclic electro thermal melting and solidification, and then causing a gaseous pressure condition to exist within said vessel that is substantially equal to ambient pressure surrounding said vessel when said nonconductive material is in a molten state.

3. The method of loading a normally solid electrically nonconductive material of a kind that becomes conductive when in a molten state and is suitable for cyclic melting and solidification into an electro thermal storage vessel which comprises the steps of introducing a predetermined quantity of said material into said vessel while said material is in a molten state, introducing a predetermined quantity of an electrically conductive particulate material onto a surface of said molten nonconductive material, and then sealing said vessel gas-tight to enclose the materials introduced therein for cyclic electro thermal melting and solidification of the normally solid nonconductive material.

4. The method according to claim 3 wherein the electrically conductive particulate material is of less density and has a higher melting point than the molten material so as to float on and become an integral part of the surface thereof.

5. The method of loading a normally solid electrically nonconductive material of a kind that becomes conductive when in a molten state and is suitable for cyclic melting and solidification into an electro thermal storage vessel which comprises the steps of introducing a predetermined quantity of said material into said vessel while said material is in a molten state, introducing a predetermined quantity of an electrically conductive particulate material onto a surface of said molten material, allowing said molten material to solidify, then sealing said vessel gastight to enclose the materials introduced therein, and then reducing gaseous pressure in said vessel to a condition that will expand to ambient atmospheric pressure when the normally solid material is heated to a molten state.

6. The method of loading a normally solid electrically conductive material of a kind that becomes conductive when in a molten state and is suitable for cyclic melting and solidifying into a receptacle comprising a hollow vessel made of electrically conductive material having a vertically disposed electrode extending into and electrically insulated from the vessel, said vessel having a sealable opening in its upper portion and said electrode extending beyond the center of the vessel, which comprises the steps of introducing said normally solid material into said vessel through said opening while said material is in a molten state, introducing a particulate conductive material onto a surface of the molten material in an amount sufficient to extend from said electrode to a wall of the vessel, and then sealing said opening to provide a pressure tight enclosure for the said molten material.

7. The method of loading a normally solid electrically nonconductive material of a kind that becomes conductive when in a molten state and is suitable for cyclic melting and solidifying into a receptacle comprising a hollow vessel made of electrically conductive material having a vertically disposed electrode extending into and electrically insulated from the vessel, said vessel having a sealable opening in its upper portion and said electrode extending beyond the center of the vessel, which comprises the steps of introducing said nonconductive material into said vessel through said opening while in a molten state, introducing a particulate conductive material onto a surface of said molten nonconductive material in an amount sufficient to extend from said electrode to a wall of the vessel, and then sealing said opening to provide a pressure tight enclosure for the said molten nonconductive material.

* * * * *